US005452046A

United States Patent [19]

Ishida et al.

[11] Patent Number: 5,452,046

[45] Date of Patent: Sep. 19, 1995

[54] AUTOMATIC DEVELOPING APPARATUS FOR PROCESSING SILVER HALIDE COLOR PHOTOGRAPHIC LIGHT-SENSITIVE MATERIAL

[75] Inventors: Kenji Ishida; Hiroshi Yoshimoto, both of Hino, Japan

[73] Assignee: Konica Corporation, Tokyo, Japan

[21] Appl. No.: 320,494

[22] Filed: Oct. 7, 1994

Related U.S. Application Data

[62] Division of Ser. No. 71,314, Jun. 2, 1993.

[30] Foreign Application Priority Data

Jun. 29, 1992 [JP] Japan ..... 4-194784

[51] Int. Cl.[6] ..... G03D 3/02

[52] U.S. Cl. ..... 354/324; 430/450

[58] Field of Search ..... 354/324, 328; 430/450, 430/398–400, 458, 465

[56] References Cited

U.S. PATENT DOCUMENTS

| | | | |
|---|---|---|---|
| 5,240,822 | 8/1993 | Tanaka et al. | 430/450 |
| 5,316,898 | 5/1994 | Ueda et al. | 430/400 |
| 5,318,061 | 6/1994 | Saito | 354/324 |
| 5,336,588 | 8/1994 | Ueda | 430/465 |
| 5,351,103 | 9/1994 | Komatsu et al. | 354/324 |
| 5,366,853 | 11/1994 | Yoshimoto | 430/400 |

*Primary Examiner*—D. Rutledge

*Attorney, Agent, or Firm*—Frishauf, Holtz, Goodman, Langer & Chick

[57] ABSTRACT

An automatic developing apparatus for processing an exposed silver halide color photographic light-sensitive material with a processing solution comprises a processing tank containing the processing solution, a replenishing processing solution tank in which a replenishing processing solution is prepared by dissolving a processing tablet, tablet dissolving means provided in the replenishing processing solution tank, means for detecting the dissolution of the tablet and means for supplying the replenishing processing solution to the processing tank.

13 Claims, 8 Drawing Sheets

AUTOMATIC DEVELOPING APPARATUS FOR PROCESSING SILVER HALIDE COLOR PHOTOGRAPHIC LIGHT-SENSITIVE MATERIAL

This is a division of application Ser. No. 08/071,314, filed Jun. 2, 1993.

FIELD OF THE INVENTION

The present invention relates to an automatic developing apparatus for processing an exposed silver halide color photographic light-sensitive material.

BACKGROUND OF THE INVENTION

A silver halide color photographic light-sensitive material (hereinafter referred to as a light-sensitive material in case of need) requires, after being exposed to light, processing steps including developing, desilvering, washing, stabilizing and drying. For carrying out the processing steps mentioned above, there are various methods available among which an ordinary method is an immersion processing method wherein each of processing tanks provided for processing steps is filled with a predetermined processing solution therefor, and a light-sensitive material is led to the processing tanks in succession and transported to be processed.

The automatic developing apparatus of immersion processing type mentioned above employs a method for supplying a replenishing processing solution prepared in a replenishing processing solution tank to a processing solution depending on an amount of the material processed, mainly for keeping activity of a processing solution constant.

With regard to a replenishing processing solution, it is common that a user himself makes the solution in a replenishing processing solution tank by preparing in advance the solution supplied in a form of powder or a condensed solution. For preparing a replenishing processing solution from a powdered processing agent, it is necessary to prepare a solution by dissolving it in a fixed amount of water, for preparing a replenishing processing solution from a condensed solution, while it is necessary to conduct operations of diluting it with water to a fixed amount, mixing and dissolving. These operations have been conducted manually. Therefore, the operations have been not only complexity but also may cause a problem that since a kit of condensed solutions is composed of different individual parts for the purpose of securing preservability, processing capability varies when a certain part is not added to the processing solution or a certain part in excessive amount is added to it and serious faults that especially, when the film is processed with such a solution, processing of the same film can not be redone. Because of spread of the so-called micro-lab in recent years, there has been brought about a situation wherein an unskilled person is compelled to use an automatic developing apparatus, and thereby, the problems mentioned above have become more serious and a demand for a system that does not require a user to prepare a replenishing processing solution has been raised.

On the other hand, a demand for environmental protection and resource-saving has become great on a worldwide basis, and a container of a condensed solution for a replenishing processing solution, in particular, has become an issue in a photographic field. The container is made of polyethylene which is excellent in terms of cost, convenience in storage and transport, and chemical resistance. An empty container is either scrapped as an industrial waste or incinerated. However, polyethylene has a problem that it exists on a semipermanent basis when scrapped because it has no biodegradation property, and it contributes to global warming, producing a large amount of carbon dioxide when incinerated. In addition, users complain that a large quantity of the containers stacked in a narrow work space make the space narrower.

For the solution of the problems mentioned above, there have been made various proposals. For example, Japanese Laid-open Patent Publication (hereinafter referred to as Japanese Patent L.O.P.) No. 61837/1976 discloses tablets for photographic use containing decaying agents, while Japanese Patent L.O.P. Nos. 109042/1990, 109043/1990, 39735/191991 and 39739/1991 disclose methods employing granulated processing agents for photographic use having a specific average particle size. In the methods mentioned above, however, the completion point for dissolution can not be judged in the so-called micro-lab due to an unskilled person there when preparing a replenishing processing solution by dissolving tablets or granulated agents, thus, the replenishing processing solution is used up before the thorough dissolution therein, resulting in problems that insoluble substances adhere to a photographic light-sensitive material to affect developing or processing efficiency or problems that a filter portion is clogged with the insoluble substances, although the completion point for dissolution can be judged experimentally from a color of the dissolved solution or the like when the replenishing processing solution is prepared by a skilled person.

For social environmental and economic reasons, on the other hand, a high concentration and low replenishing processing system tends to be used in the recent trend. In the system, dissolving efficiency is extremely poor because of the high concentration of dissolved solution, and the problems described above are becoming more serious. It is further feared that another problem arises that crystals may be precipitated only because o wrong sequence of mixing a processing agent kit.

Further, as a method for eliminating the dissolving operation, Japanese Patent L.O.P. No. 11344 discloses a technology wherein paste-like parts agents (also called part agent) in an amount corresponding to a mixing ratio of the parts agents are squeezed out of each unit container and the parts agents squeezed out are diluted to a predetermined concentration for preparing and supplying a solution accurately. Owing to this method, dissolving operation may be either lessened or eliminated for certain, but it is difficult to squeeze out paste-like parts agents in a predetermined amount, and a nozzle tends to be clogged when the method is not used frequently.

In Japanese Patent L.O.P. No. 199357/1988, there is disclosed a technology wherein a tablet which is a mixture of a chemical that enhances the electrical conductivity and a sterilizer is introduced into a replenishing processing solution tank for a water washing-substituting stabilizing processing solution. This technology, however, can be utilized only in the case of a water washing-substituting stabilizing processing solution wherein processing efficiency is not affected even when an amount of the introduced tablets varies, and it can not be utilized for preparation of a replenishing processing solution for a processing solution that is used for developing and bleaching or bleach-fixing and fixing of a color photographic light-sensitive material.

In Japanese Patent L.O.P. No. 29136/1992, there is disclosed a technology wherein a solid agent for developing a monochromatic photographic light-sensitive material and that for fixing the same are introduced to be dissolved into a replenishing processing solution and a period of time from introducing the agent into the solution to sending it to a processing tank is required to be regulated. However, neither means for dissolving the agent thoroughly nor means for confirming thorough dissolution thereof is provided. In addition, there is provided no means for removing insoluble objects even when they exist. Therefore, it is risky to utilize the technology for processing a color film.

SUMMARY OF THE INVENTION

The present invention has been achieved in view of the foregoing, and its first object is to provide an automatic developing apparatus capable of releasing a user from preparation of a replenishing processing solution and of reducing polyethylene containers which have conventionally been used for a kit of a replenishing processing solution. The second object thereof is to provide an automatic developing apparatus wherein dissolution of processing tablets has been improved and thereby stable and excellent processing efficiency can be obtained. The third object is to provide an automatic developing apparatus with which an efficiency of operations in a micro-lab has been improved remarkably, and the fourth object is to provide an automatic developing apparatus capable of preparing a replenishing processing solution which causes no crystal precipitation and is suitable for a high concentration and low replenishing system. The fifth object of the invention is to provide an improved automatic developing apparatus capable of causing existing automatic developing apparatuses already installed to be those achieving the first object through the fourth object mentioned above by utilizing them as they are.

DETAILED DESCRIPTION OF THE INVENTION

Figure 1:
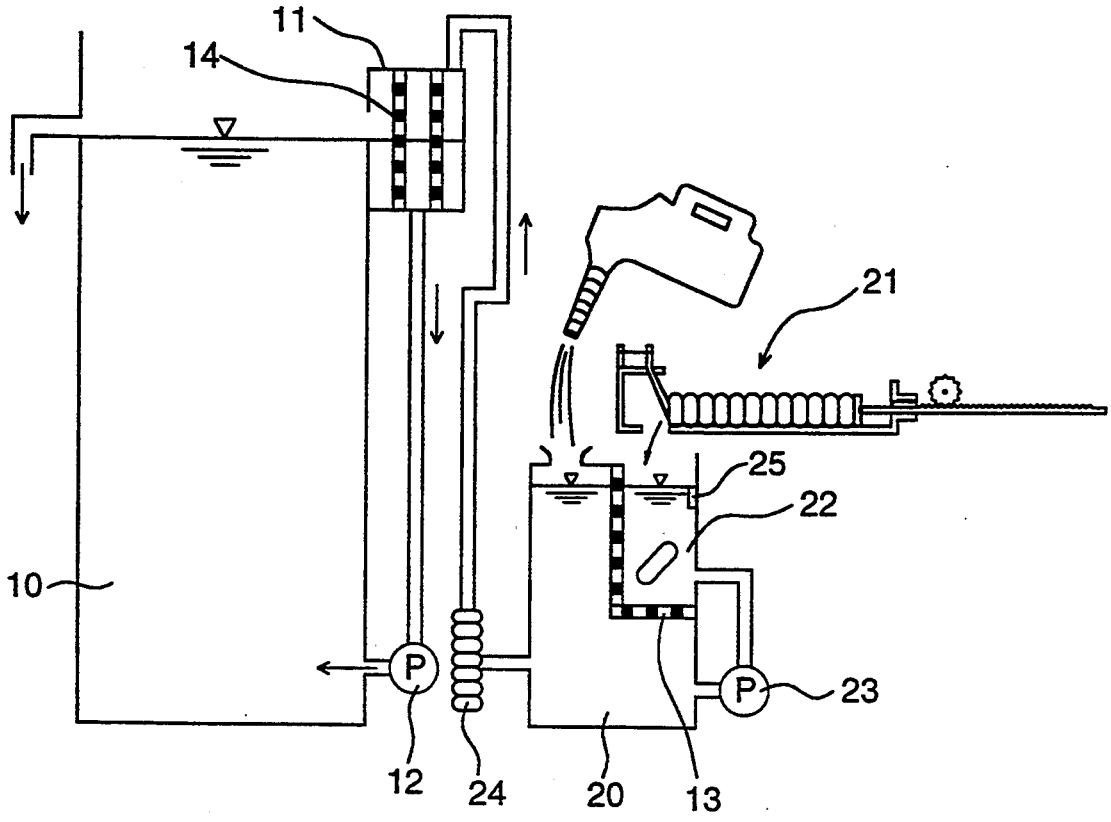
FIG. 1 represents a schematic diagram of primary portions showing an example of the invention, and each of FIGS. 2–8 represents a schematic diagram of primary portions showing other examples of the invention.

The above objects of the invention can be attained by an automatic developing apparatus for processing an exposed silver halide color photographic light-sensitive material with a processing solution comprising:

- a processing tank containing the processing solution;
- a replenishing processing solution tank in which a replenishing processing solution is prepared by dissolving a processing tablet;
- tablet dissolving means provided in the replenishing processing solution tank; and
- means for supplying the replenishing processing solution to the processing tank, wherein the dissolving means comprises means for circulating the replenishing processing solution into which the tablet has been introduced, means for applying supersonic vibration to the replenishing processing solution into which the tablet has been introduced, means for stirring the replenishing processing solution into which the tablet has been introduced or means for rotating, moving up and down or vibrating the whole or a part of a cage-like container into which the processing tablet has been introduced or an object attached thereto, the cage-like container being immersed in the replenishing processing solution.

It is preferable that the apparatus of the invention further comprises means for automatically introducing the tablet into the replenishing processing solution, means for crushing the tablet, means for detecting the dissolution of the tablet, or means for removing an insoluble substance in the replenishing processing solution.

The processing tablet used in the invention comprises a tablet for color developer, a tablet for bleacher and a tablet for bleach-fixer. Each of the tablet for color developer, bleacher and bleach-fixer is preferably a single tablet. The bulk density of the processing tablet is 1.0 to 2.5 g/cm$^3$.

The invention having the distinguishing characteristics mentioned above will be explained in detail as follows.

First of all, kinds, features, shapes, properties, specific characteristics an manufacturing methods of tableted processing agents (hereinafter referred to as processing tablets) for color photography use employed in the automatic developing apparatus of the invention will be explained.

The processing tablets used in the invention include those of a color developing agent, a black and white developing agent, a bleaching agent, a fixing agent, a bleachfixing agent and a stabilizing agent.

In the invention, "tablet" means a tabular or a massive (for example, lens-shaped, spherical, triangular, square, columnar or cylindrical) chemical formed by pressing powder or granules of a component or composition of photographic processing agents through compression molding, which releases the photographic processing agents when dissolved in dissolving water or a processing solution. For example, powder of processing agents for photographic use may be mixed with excipients or binders to be formed by a compression molding machine so that it may have a constant size and hardness, which has an advantage that an amount used is accurate. Incidentally, the size thereof may be determined in accordance with practical application.

With regard to the form of the tablet, it has only to be a tablet-shaped one and it includes a single and solid tablet in a massive shape, a tablet wherein powder or granules are wrapped with an alkali-soluble film or a water-soluble film and a tablet wherein a liquid (for example, a solvent) is covered by a capsule formed with resins or the like.

In order to prepare processing agents for photographic use to be in a shape of a tablet, any means can be employed including, for example, means for forming a tablet by kneading photographic processing agents in a form of a condensed liquid, fine powder or granules and water-soluble binders and means for forming a covering layer by spraying the surface of a temporarily-formed photographic processing agents with water-soluble binders (See Japanese Patent L.O.P. Nos. 29136/1992, 85535/1992, 85536/1992, 85533/1992, 85534/1992 and 172341/1992).

General methods disclosed, for example, in Japanese Patent L.O.P. Nos. 61837/1976, 155038/1979, and 88025/1977 as well as in British Patent No. 1213808 may be used for causing processing agents to be in a form of a tablet, general methods disclosed, for example, in Japanese Patent L.O.P. Nos. 109042/1990, 109043/199039735/1991 and 39739/1991 may be used for granulating the processing agents, and general methods disclosed, for example, in Japanese Patent L.O.P. No. 133332/1979, British Patent Nos. 725892 and 729862 and German Patent No. 3733862 may be used for powdering the processing agents.

For tableting processing agents, either direct tableting or tableting after granulating may be acceptable. When considering satisfactory dissolution, however, tableting after granulating is preferable.

It is preferable from a viewpoint of dissolution that bulk density of processing tablets mentioned above is within a range of 1.0–2.5 g/cm$^3$, and preferably 1.1–2.2 g/cm$^3$.

When alkali agents such as potassium carbonate, sodium carbonate, potassium hydroxide, potassium phosphate, potassium hydrogen carbonate and sodium hydroxide are contained in tableted processing agents for photographic use, degeneration caused by saponification by means of alkali agent in a water-soluble film in the course of covering with the water-soluble film can be improved by binding or covering a part or the whole of the alkali agents with water-soluble binders, which is an advantage.

When covering processing agents with a water-soluble film, or when binding or covering processing agents with a binder, a water-soluble film or a binder which is preferably used is made of base materials such as a polyvinyl alcohol, a methyl cellulose, a polyethylene oxide, a starch, a polyvinyl pyrrolidone, a hydroxypropyl cellulose, a pullulan, a dextran and gum arabic, a polyvinyl acetate, a hydroxyethyl cellulose, a carboxyethyl cellulose, sodium carboxymethylhydroxyethylcellulose, a poly (alkyl) oxazoline, and a polyethylene glycol. Among them, those made of base materials such as a polyvinyl alcohol and a pullulan are used more preferably.

Since a polyvinyl alcohol has its excellent strength and flexibility, it may be used preferably for a processing tablet. Though a polyvinyl alcohol available on the market which are molded as a film has various molecular weights and degrees of hydrolysis, it is preferable that the molecular weight is within a range from about 10,000 to about 100,000. The degree of hydrolysis in this case means the rate at which an acetic ester group of a polyvinyl alcohol is substituted with a hydroxyl group. When applying to a film, a range of hydrolysis to be allowed is usually from about 70% to 100%. As shown above, a term of polyvinyl alcohol usually includes a polyvinyl acetate compound.

These water-soluble films and binders are manufactured through ordinary methods such as those disclosed in, for example, Japanese Patent L.O.P. Nos. 124945/1990, 97348/1986, 158245/1985, 86638/1990, 117867/1982, 75650/1990, 226018/1984, 18741/1988 and 13565/1979.

In the invention, when covering with a water-soluble polymer the processing agents to be tableted, it is possible to employ any means including, for example, a method wherein the surface of a tablet made through ordinary methods such as those disclosed in, for example, Japanese Patent L.O.P. Nos, 61837/1976, 155038/1979 and 88025/1977 and British Patent No. 1213808 is sprayed with a water-soluble polymer in a coating pan.

With regard to an amount of water-soluble polymers used for covering processing agents by means of a coating method, it is preferable that the amount of the water-soluble polymers converted into concentration thereof in a solution containing the water-soluble polymers is not less than 0.01 g/1 l of processing agent solution from viewpoints of storage stability, wear resistance and solubility. Further, a range of 0.5–3.0 g/1 l of processing agent solution is more preferable.

When tableting photographic processing agents, either a method for tableting all components for each agent to be a single tablet or a method for tableting the components to be a plurality of tablets may be employed. Or, it is also possible to use a method wherein a part of constituting components is tableted to be one or more tablets and the remains are made to be one or more liquid or powder. Any arrangement may be taken in accordance with characteristics and required capability of the processing agents. It is further possible to employ a method for making a tablet wherein all components are mixed uniformly, or a method for making a tablet wherein each component is tableted to form a multi-layer structure. Furthermore, a method for making a tablet wherein the structure of its inside is different from that of the outer portion of the tablet may also be used. The tablet used in the invention is preferably a single tablet for each agent.

Tableting may be performed before preliminary processes such as granulating, mixing with binders and coating the coating agents which are generally conducted.

Application and composition of tableted processing agents for photographic use used in the invention will be explained as follows.

When a processing tablet used in the invention is a color developing agent, (C-1)–(C-16) described on pages 26–31 of Japanese Patent L.O.P. No. 86741/1992, (1)–(8) described on pages 29–31 of Japanese Patent L.O.P. No. 289350/1986 and (1)–(6) described on pages 5–9 of Japanese Patent L.O.P. No. 246543/1991 are cited as exemplified compounds of color developer substances used preferably in the color developing agent. Exemplified compounds (C-1) and (C-3) described in Japanese Patent L.O.P. No. 86741/1992, exemplified compound (2) described in Japanese Patent L.O.P. No. 289350/1986 and exemplified compound (1) described in Japanese Patent L.O.P. No. 246543/1991 are given as those especially preferable.

Further, hydroxylamine type compounds or hydrazine type compounds are used preferably for color developing agents.

Concrete examples of hydroxylamine type compounds are disclosed in U.S. Pat. Nos. 3,287,125, 33,293,034 and 3287124, and concrete exemplified compounds especially preferable are represented by (A-1)–(A-39) described on pages 36–38 of Japanese Patent L.O.P. No. 86741/1992, (1)–(54) described on pages 4–6 of Japanese Patent L.O.P. No. 37749/1992, (1)–(53) described on pages 3–6 of Japanese Patent L.O.P. No. 33845/1991 and (1)–(52) described on pages 5–7 of Japanese Patent L.O.P. No. 63646/1991. Exemplified compounds which are preferable in particular include (1) HON $(CH_2CH_2SO_3H)_2$ and (2) HON$(CH_2CH_2COOH)_2$.

As concrete examples of hydrazine type compounds, (B-1)–(B-33) described on pages 40–43 of Japanese Patent L.O.P. No. 86741/1992 and (1)–(56) described on pages 4–6 of Japanese Patent L.O.P. No. 33846/1991 are given When a processing agent used in the invention is a bleaching agent or a bleach-fixing agent, ferric complex of (IV-1)-(IV-12) described in Paragraph Nos. 0086-0087 of Japanese Patent L.O.P. No. 353842/1992 may be given as a preferable beaching agent.

Further, when a processing agent used in the invention is a stabilizing agent, compounds contained in a stabilizing agent are not limited in particular.

The feature of the invention lies in that a means for dissolving the processing tablets mentioned above is provided on a replenishing processing solution tank, and the dissolving means will be explained as follows.

The automatic developing apparatus according to the invention is equipped with color developer tank, a bleach tank, fixing tank, a stabilizer tank (a water washing tank), and each tank is provided with a replenishing processing solution tank for supplying a replenishing processing solution to each tank mentioned above, and means for dissolving the processing tablets is provided in each replenishing processing solution tank.

As first dissolving means, there is given means wherein a solution into which processing tablets are introduced is circulated for dissolution in a replenishing processing solution tank.

In means for dissolving by circulating a solution, a solution in a replenishing processing solution tank is forcefed by a pump or the like for circulation, and dissolution is carried out by a flow of the solution. Various types of pumps or screws are used as means for force-feeding the solution. As a flow rate, 1l/min. or more is preferable, and 2-30 l/min. is more preferable. Further, a method for causing a solution to jet out of a nozzle is preferable because dissolution can be accelerated. There are various types of nozzles available including a rectilinear nozzle, a fan-shaped nozzle, a circular nozzle, a whole-surface nozzle and a circular ring type nozzle. The stronger the impact force of the nozzle and the more the fine vibration given to the processing agents to be treated, the better the effectiveness of the nozzle is. As an arrangement for positioning a pump, there can be menthioned of an example wherein an area for introducing processing tablets is provided at a certain portion of a replenishing processing solution tank and a solvent pumped up from the bottom of the replenishing processing solution tank is supplied to the area. However, the invention is not limited thereto.

As second means for dissolving, means for dissolving by giving supersonic vibration to the solution projected with processing agents may be given. In this method, a supersonic generator is provided on the bottom or the side of the replenishing processing solution tank and thereby supersonic vibration is given to a solution to vibrate processing tablets either directly or indirectly for accelerating the dissolution. As a supersonic generator, a magnetostrictive nickel vibrator (horn type) manufactured by Choonpa Kogyo Corporation and a magnetostrictive barium titanate vibrator (holder type) are used. With regard to the frequency of the vibrator in a supersonic generator, those ranging from 5 KHz to 1000 KHz are used, and those ranging from 10 KHz to 50 KHz are preferable from the viewpoints of dissolving efficiency and prevention of damage of machine parts in an automatic developing apparatus.

For the purpose of accelerating dissolution by means of a supersonic vibration, it is preferable to accelerate not by vibrating a solution simply but by providing a receiving member that receives processing agents at the bottom of a replenishing processing solution tank or at a portion of the wall thereof and thereby vibrating the receiving member to vibrate directly the processing agents. Even in the case of a method for vibrating indirectly through a solution, it is preferable, from the viewpoint of attenuation of the vibration, to shorten the distance between a vibration source and processing agents as much as possible. It is also preferable to provide a reflection plate further.

As third dissolving means, there may be given means wherein means for stirring a solution supplied with processing agents is provided in a replenishing processing solution tank for dissolving. As technical means for stirring, various conventional stirring means which are widely known may be used. These means include means employing rotating blade, means of rotating a rotator such as a stirrer, means employing a stirring bar and others.

As fourth dissolving means, there may be given dissolving means that dissolves processing agents wherein a cage-like body that rotates, moves up and down or vibrates is immersed in a solution in a replenishing processing solution tank, processing tablets are introduced into the cage-like body, and the whole or a part of the cage-like body or an object attached thereto is rotated or vibrated. There is no limit for the relative size of the cage-like body to the replenishing processing solution tank. Various conventional rotating or vibrating means widely know are used.

A cage-like body that is preferably used includes one wherein many holes are provided on the surface of a cylinder or a square pillar and one wherein a cylinder is formed with a net. The object attached to the cage-like body includes a rotator provided in the cage, a vibration plate and a bar.

Means for crushing processing tablets before or after the introduction of the processing tablets into the replenishing processing solution tank is preferably provided for the purpose of accelerating the dissolution carried out by the aforementioned dissolving means of the processing agents. As technical means of the crushing, there may be employed various methods such as a crusher that crushes processing tablets introduced into the clearance of a pair of rollers or gears and a crusher that crushes processing tablets by causing them to hit the vibrating member.

When a replenishing processing solution is supplied to a processing solution tank before processing tablets introduced into the replenishing processing solution tank is dissolved thoroughly, composition of the processing solution is varied, resulting in an occurrence of processing problems. Therefore, it is preferable to provide means for detecting that processing tablets introduced into the solution (water or warm water) prepared in the replenishing processing solution tank have been dissolved thoroughly. For detecting the dissolution, a method by visual observation or a method for detecting automatically turbidity of the solution, colorimetry, conductivity, oxidation-reduction potential, pH and specific gravity of the solution or a composite method of the two mentioned above, for example, is employed. For the visual observation, transparent window, for example, is provided in the replenishing processing solution tank.

Further, it is also preferable to structure so that operations of the dissolving means mentioned above may be controlled by control signals of the means for confirming the dissolution.

It is also advantageous to provide means for removing insoluble substances of the processing tablets introduced into a solution. As means for removing the insoluble substances, a method by means of overflowing, a method by means of a filter, a method by means of precipitation and a composite method including the aforementioned methods are used.

In an embodiment wherein means for removing insoluble substances is provided, there are advantages that processing problems are prevented, and unsoluble films or capsules can be used for forming the processing tablets.

A big advantage of the invention is that it is possible to utilize an existing automatic developing apparatus as an automatic developing apparatus of the invention not by modifying the existing automatic developing apparatus extensively but by incorporating a few components or units in the apparatus.

EXAMPLES

Next, the automatic developing apparatus of the invention having the aforementioned distinguishing characteristics will be explained in detail, referring to the illustrated examples.

Incidentally, examples which will be explained below are for exemplification, and the scope of the invention is not limited by the examples.

Example 1

FIG. 1 is a schematic diagram of primary portions of an automatic developing apparatus in which means of dissolving processing tablets through circulation is incorporated. The symbol 10 represents a processing tank such as a color developing tank wherein a processing solution is stored. A photographic light-sensitive material to be processed is transported by unillustrated transport means through the processing solution, and is subjected to immersion processing on the half way. After processing of the predetermined amount of the material, a replenishing processing solution in subtank (filter tank) 11 is supplied to processing tank 10 by pump 12, and overflowed solution is discharged through an outlet for the overflow.

On the top of replenishing processing solution tank 20, there is provided means for introducing automatically processing tablets 21 into tank 20, and the necessary number of tablets based upon the signals of introduction by an operator are introduced into section 22. The section 22 is formed by net or plate 14 having thereon many small holes. Incidentally, before or after the processing tablets are introduced, a predetermined amount of solution (water or warm water) is poured into the replenishing processing solution tank 20 with a pitcher or the like. Incidentally, processing tablets may also be introduced manually on a timely basis without the use of an automatic device.

After introduction of processing tablets, pump 23 is driven to carry out circulation of a solution wherein the solution is pumped up from the bottom of the replenishing processing solution tank 20 and then is jetted into the section 22. It is preferable that a solution jet outlet is made to be a nozzle so that the solution may be jetted forcibly to hit processing tablets strongly.

When means for detecting the dissolution of the tablets, 25 confirms that circulation of a solution made by driven pump 23 has been conducted for a certain period of time and all processing tablets have been dissolved thoroughly, preparation of a replenishing processing solution is completed and the operation of the pump 23 is stopped, thus, a replenishing processing solution becomes ready to be sent by bellows pump 24 or the like to sub-tank 11 at any time.

with regard to the flow rate of circulation, the flow rate is preferably 50% or more per minute of a solution in tank 20, and more preferably, 75 to 500% per minute of the solution. When scattering of a solution and capacity of a pump are considered, the flow rate which is too great is not preferable.

The invention may also take another embodiment wherein a motor pump is used in place of bellows pump 24, and thereby a replenishing processing solution may be pumped up to sub-tank 11 and then supplied to processing tank 10 not by means of pump 12 but by an overflow.

In the embodiment described above, filter 13 in the subtank 11 functions as means for removing insoluble substances caused by processing tablets mingled in the replenishing processing solution. A filter can be provided in the preceding step of bellows pump 24, for example, which is also preferable. In such an embodiment, it is possible to supply a replenishing processing solution from the replenishing processing solution tank 20 to the processing tank 10 directly without using sub-tank 11.

For dissolving more rapidly and more thoroughly, it is preferable that means for crushing processing tablets described later is provided.

Figure 2:
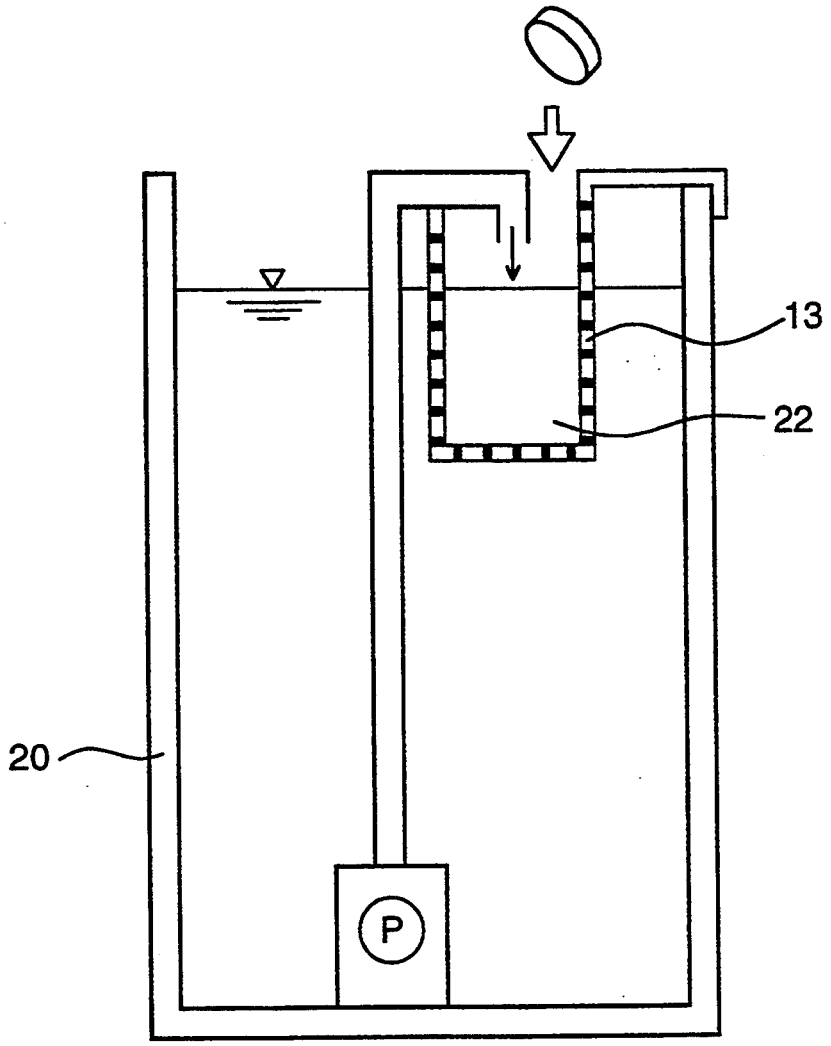

A great advantage of the invention is that it is possible to utilize an existing replenishing processing solution tank in a conventional automatic developing apparatus as replenishing processing solution tank 20. The foregoing can be realized by the constitution for dissolving processing tablets wherein a submersible pump is used as pump 23 for circulating a solution as shown in FIG. 2, the solution is pumped up by the submersible pump submerged in (existing) replenishing processing solution tank 20, and the solution thus pumped up is jetted against processing tablets introduced in a member, section 22 mounted on the top edge of the (existing) replenishing processing solution tank 20. In the embodiment mentioned above, the member that serves as the section 22 may be either one immersed in a solution in the replenishing processing solution tank 20 or one positioned above the surface of the solution. With regard to a position for locating the section 22 and a jetting position of the solution, the same embodiment can be taken in the example shown in FIG. 1.

Further, an embodiment wherein the submersible pump and section 22 are united in a body is preferable for the purpose of incorporating simply in existing replenishing processing solution tank 20.

Figure 3:
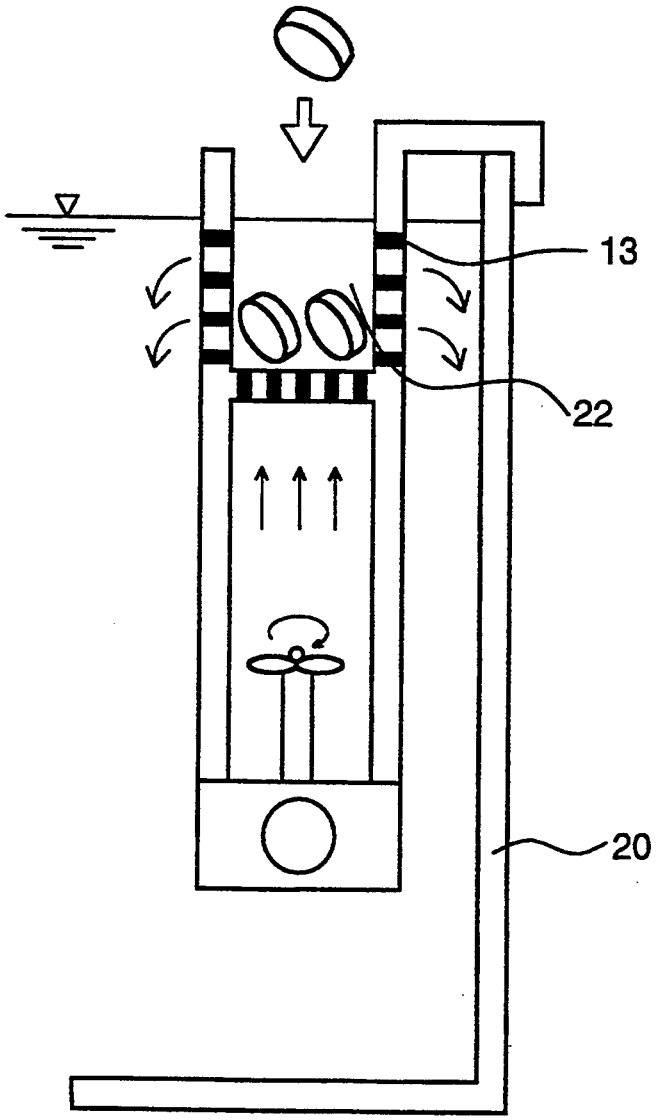

It is also possible to dissolve processing tablets in a way wherein a screw rotated by a motor is positioned in a cylinder provided at the lower portion of the section 22 and a rotation of the screw creates a return current of a solution in the arrowed direction as shown in FIG. 3.

Example 2

In the present example, processing tablets are dissolved by supersonic vibrations, and there are two embodiments including 1 an embodiment wherein a supersonic generator is provided on the bottom or side wall of replenishing processing solution tank 20 to vibrate processing tablets indirectly by giving supersonic vibrations to the solution, and 2 an embodiment for accelerating dissolution by vibrating processing tablets directly. From the viewpoint that a replenishing processing solution tank in an existing automatic developing apparatus is utilized as it is, it is preferable that means for dissolving by means of supersonic vibrations can be employed as an independent device so that it may be mounted removably and it can be mounted easily on the existing replenishing processing solution tank.

Figure 4:
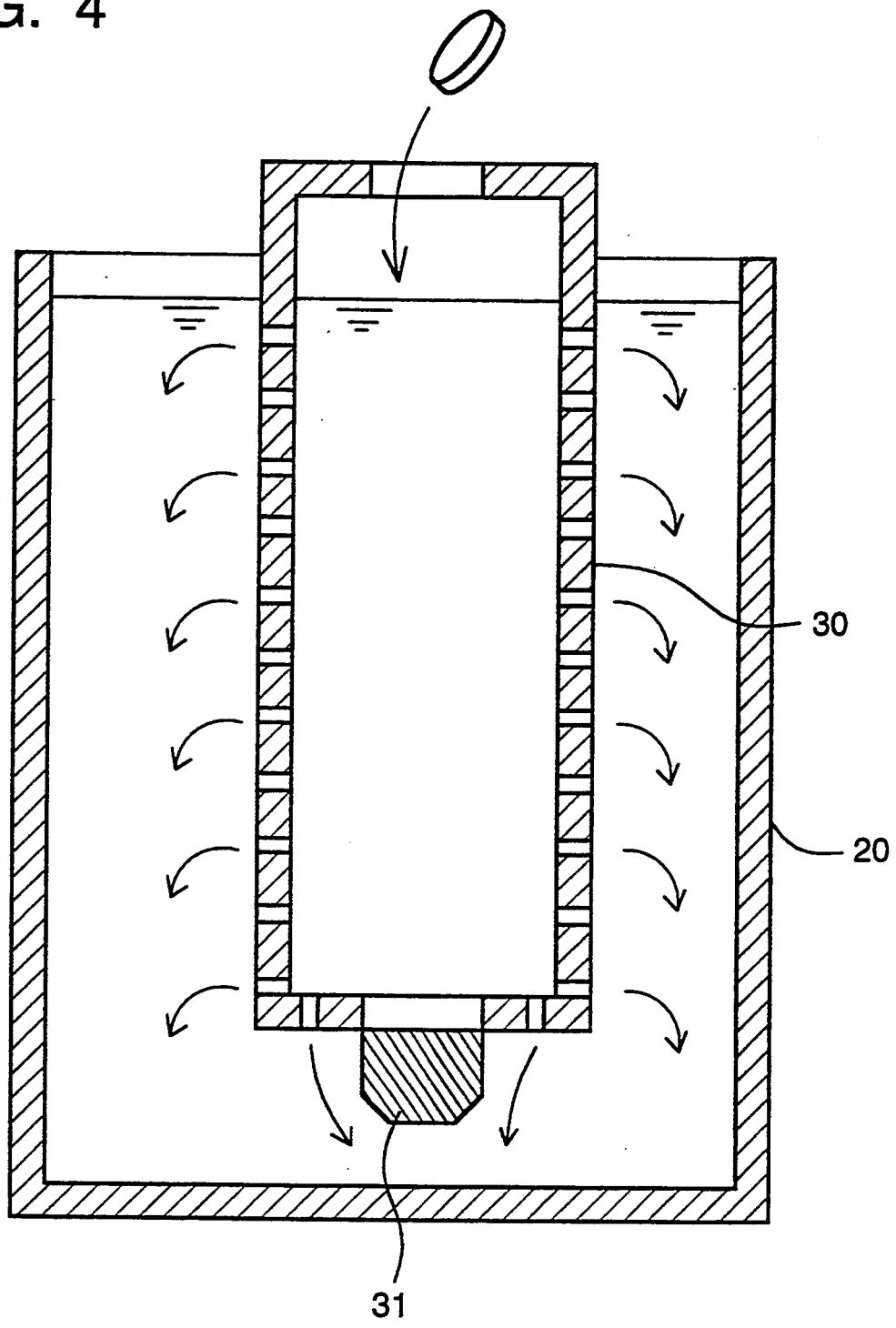
Figure 5:
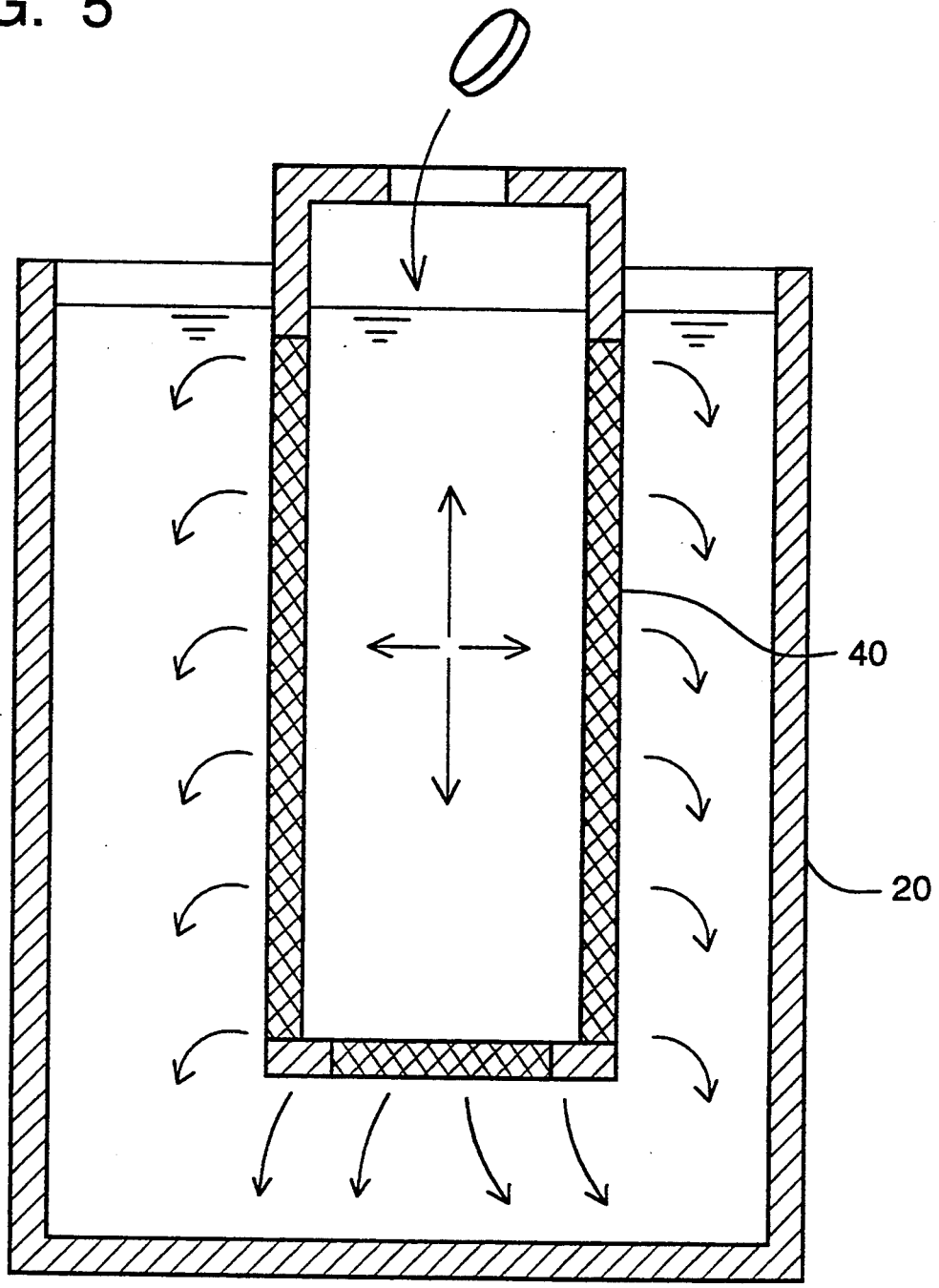

From the viewpoint mentioned above, vibrator 31 is provided at the lower end of cylindrical or bag-shaped object 30 and the vibrator 31 is vibrated through an unillustrated electric circuit to accelerate dissolution of processing tablets in the example shown in FIG. 4. The cylindrical or bag-shaped object 30 may be made of a laminar material having thereon many holes or of a net.

In a dissolving means of the embodiment described above, a magnetostrictive nickel vibrator (horn type) manufactured by Choonpa Kogyo Corporation and a magnetostrictive barium titanate vibrator (holder type), for example, are used. The frequency of the vibrator is from 5 to 1000 KHz, and preferably from 10 to 50 KHz from the viewpoints of dissolving efficiency and prevention of damage of machine parts in an automatic developing apparatus.

For enhancing the dissolving efficiency, it is preferable that processing tablets are in contact with vibrator 31 or both of them are close together as far as possible. When a reflection plate is provided behind processing tablets so that reflected vibration of a solution may hit processing tablets, dissolving efficiency by means of vibration can be enhanced.

The vibrator 31 may be positioned at the bottom of replenishing processing solution tank 20 or it may be attached to an inner wall of the replenishing processing solution tank 20. An embodiment wherein a processing tablet-receiving member is provided on the front side of vibrator 31 and processing tablets are supplied to the receiving member to give vibration more effectively is also preferable. The constitution wherein the receiving member itself is vibrated is also workable.

Further, it is preferable that means for supplying processing tablets and means for detecting the dissolution are incorporated in addition to the dissolving means by means of supersonic vibration mentioned above.

Example 3

In this example, means for stirring a solution into which processing tablets have been introduced is provided inside a replenishing processing solution tank for dissolving.

As a technical means for stirring, various types of known stirring means such as one by means of a rotation of blades, one by means of a rotation of a rotor such as a stirrer, one by means of a stirring bar and others can be utilized.

For the purpose of utilizing an existing automatic developing apparatus as it is, it is preferable that stirring means can be mounted easily on a replenishing processing solution tank in the automatic developing apparatus requiring no modification. Further, it is preferable that means for confirming the degree of dissolution is incorporated in the apparatus conducting the aforementioned stirring.

Example 4

In the present example, cage-like container 40 is immersed in a solution in replenishing processing solution tank 20, processing tablets are introduced into the cage-like container 40, and the cage-like container 40 is rotated, moved up and down or vibrated to accelerate the dissolution of the processing tablets.

The same object as the foregoing can be attained by rotating, moving up and down or vibrating not the whole but a part of cage-like container 40.

The cage-like container 40 that is preferably used includes one wherein many holes are provided on the surface of a cylinder or a square pillar and one wherein a cylinder is formed with a net.

As a mechanism for rotating, moving up and down or vibrating the whole or a part of the cage-like container 40, various types of motors, pinion-rack mechanisms, various types of oscillating mechanisms, straight reciprocating mechanisms, and other various types of moving mechanisms can be utilized, and there is no restriction for mechanical constitution.

Figure 6:
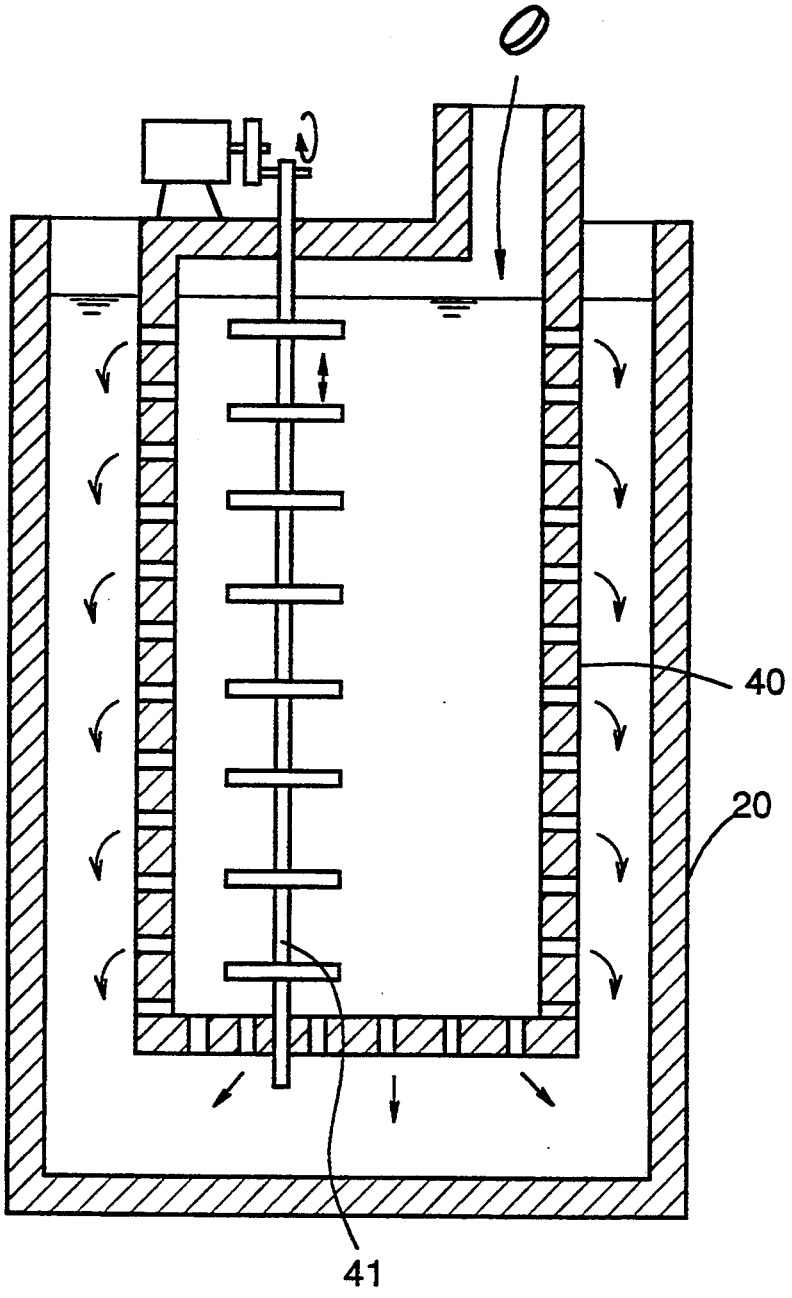

In the embodiment shown in FIG. 6, dissolution of processing tablets is accelerated when stirring member 41 is rotated by a motor with the cage-like container 40 being fixed stationarily. The stirring member 41 may be either a bar or a vibrating plate.

Example 5

In order to accelerate dissolution conducted by means of dissolving means in Examples mentioned above, it is preferable to provide means for crushing processing tablets before or after introducing the processing tablets into a replenishing processing solution tank.

Figure 7:
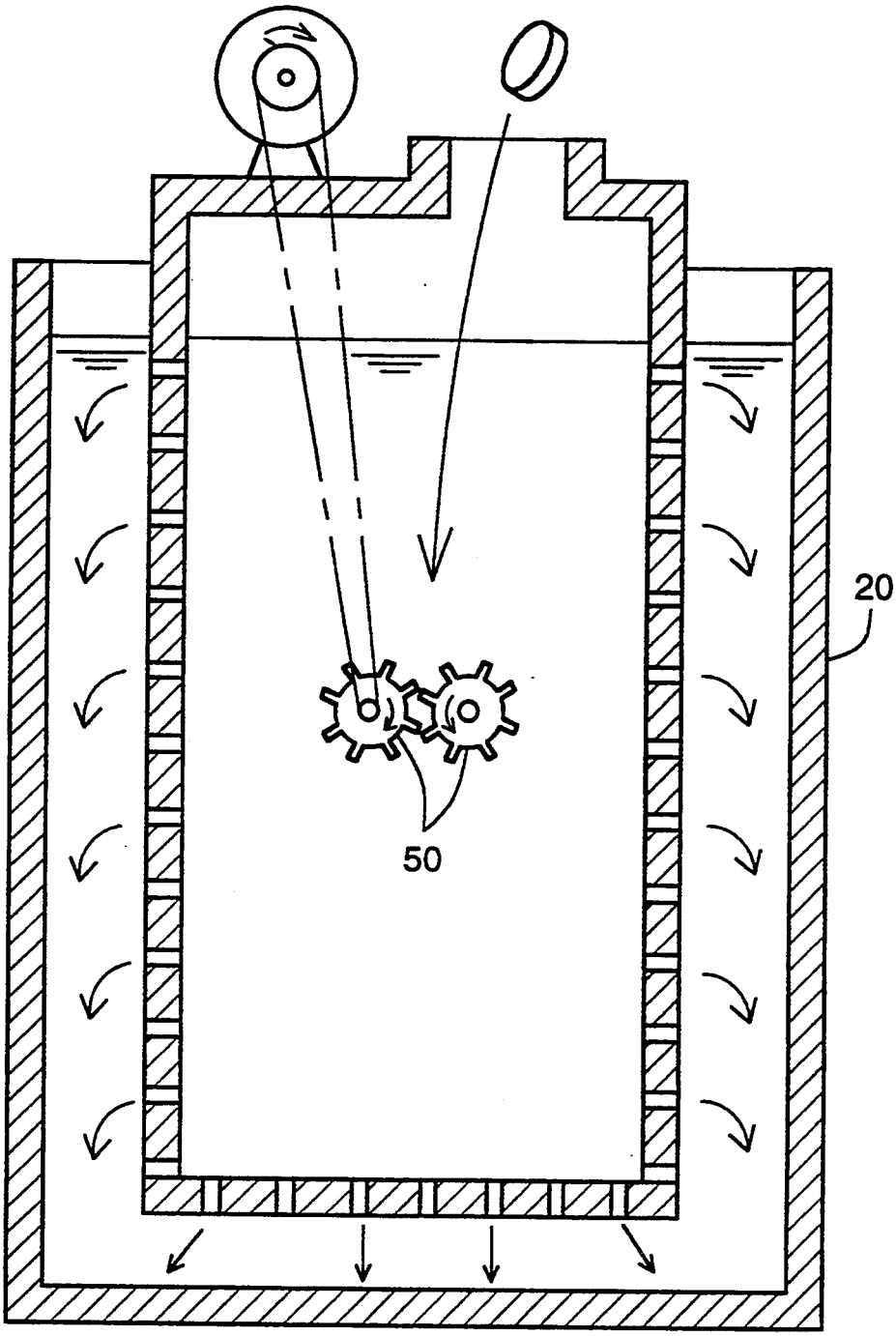
Figure 8:
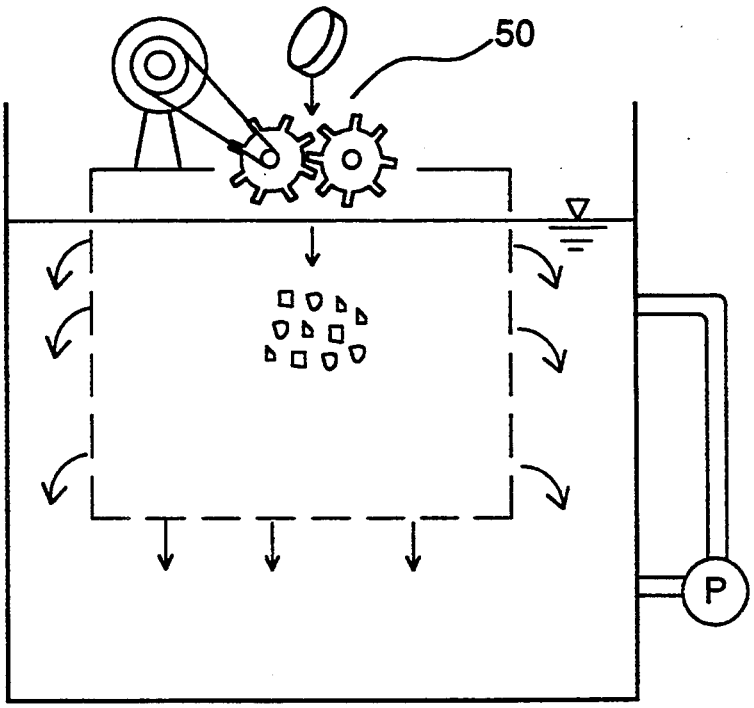

Means for crushing processing tablets are exemplified in FIGS. 7 and 8. In the embodiment shown in FIG. 7, crusher 50 is provided in a solution in replenishing processing solution tank 20 for crushing processing tablets. In the embodiment shown in FIG. 8, crusher 50 is positioned above the surface of a solution.

What is claimed is:

1. An automatic developing apparatus for processing an exposed silver halide color photographic light-sensitive material which comprises:

a first tank, a second tank, and a third tank comprising dissolving means for dissolving a processing tablet, means for supplying a solution to said second tank, the solution containing said tablet dissolved, and means for removing an insoluble substance from said solution to prevent supplying said insoluble substance to said second tank, and said second tank comprises means for supplying said solution supplied from said third tank to said first tank.

2. The apparatus of claim 1, wherein said dissolving means comprises means for circulating the replenishing processing solution in the replenishing processing solution tank.

3. The apparatus of claim 1, wherein said dissolving means comprises means for applying supersonic vibration to the replenishing processing solution in the replenishing processing solution tank.

4. The apparatus of claim 1, wherein said dissolving means comprises means for stirring the replenishing processing solution in the replenishing processing solution tank.

5. The apparatus of claim 1, wherein said dissolving means comprises means for rotating, moving up and down or vibrating a cage-like container in which a processing tablet has been introduced, said cage-like container being immersed in the replenishing processing solution.

6. The apparatus of claim 1, wherein said third tank is equipped with an area where the processing tablet is introduced and dissolved.

7. The apparatus of claim 1, further comprising means for automatically introducing a processing tablet into the third tank.

8. The apparatus of claim 1, further comprising means for crushing a processing tablet.

9. The apparatus of claim 1, wherein said processing tablet comprises a tablet for color developer, a tablet for bleach or a tablet for bleach-fixer.

10. The apparatus of claim 1, wherein said tablet for color developer, said tablet for bleach or said tablet for bleach-fixer is a single tablet.

11. The apparatus of claim 1, wherein the bulk density of each processing tablet is 1.0 to 2.5 $g/cm^3$.

12. The apparatus of claim 1, wherein said processing tablet has a bulk density of 1.0 to 2.5 $g/cm^3$.

13. The apparatus of claim 1, wherein said third tank further comprises means for detecting the dissolution of the tablet.

* * * * *